United States Patent [19]

Liu

[11] Patent Number: 5,020,511

[45] Date of Patent: Jun. 4, 1991

[54] VERTICAL TYPE SMOKELESS EXHAUSTER

[76] Inventor: Wan-Tien Liu, No. 44, Sec. 1, Yuan Lin Road, Ta Hsi Town, Taoyuan Hsien, Taiwan

[21] Appl. No.: 567,899

[22] Filed: Aug. 15, 1990

[51] Int. Cl.[5] ..... F24C 15/20

[52] U.S. Cl. ..... 126/299 R; 126/299 D; 55/DIG. 36

[58] Field of Search ..... 126/299 R, 299 D, 299 F, 126/300–303, 21 R; 98/115.1, 115.3; 55/DIG. 36

[56] References Cited

U.S. PATENT DOCUMENTS 3,011,492 12/1961 Humbert ..... 126/299 R
3,102,533 9/1963 Jenn et al. ..... 126/303
4,501,260 2/1985 Grace ..... 126/299 R
4,934,337 6/1990 Falk ..... 126/299 R

*Primary Examiner*—James C. Yeung
*Attorney, Agent, or Firm*—Bacon & Thomas

[57] ABSTRACT

A vertical type smokeless exhauster which comprises a vertical body with a guide plate holder on the top and a guide plate to trigger a micro switch by sliding a guide plate to its outermost position in order to start fan motors which suck oily smoke into a ventilation opening in the body. The oily smoke is then filtered by an oil filter element in a filter tank before it is discharged to the atmosphere. Oily contents at the fan motor and filter tank are collected by oil collectors and an oil pan, respectively.

5 Claims, 8 Drawing Sheets

VERTICAL TYPE SMOKELESS EXHAUSTER

BACKGROUND OF THE INVENTION

1. Field of the Invention

The present invention provides a vertical type smokeless exhauster which is intended to be incorporated with a dispensing table and an oven installed in a kitchen.

2. Description of the Prior Art

Conventionally, an oily smoke exhauster is installed over a dispensing table/oven to suck and exhaust smoke by fan motors and then discharge the smoke to the atmosphere directly through a discharge pipe. Since such an exhauster is installed over the oven, oily contents are adhered to the wall between the exhauster and the oven, and the installation of a cabinet at such wall is not possible. Hence, use of space is limited in a with this known exhauster.

SUMMARY OF THE INVENTION

In consideration of the above defects, the present invention provides a vertical type smokeless exhauster which has the following features:

(1) A guide plate holder with micro switch on the exhauster's body to start a fan motor for suction and exhaust of oily smoke by simply sliding out of the guide plate to trigger the micro switch.

(2) Vertical design to integrate with a dispensing table and oven.

(3) Oil filter chamber with oil filter tank and filter element to filter out oily contents from the oily smoke before it is discharged to the atmosphere.

(4) A curvilinear guide plate at an inlet port of the body to ease suction of oily smoke.

(5) Oil collectors and oil pan at the lower side of the body to collect oily residues.

(6) Closed structure with oil filter chamber to discharge smokeless gas and to collect oily residues.

The present invention provides a vertical type smokeless exhauster, particularly an exhauster which can discharge smoke without its oily content. It comprises a vertical body with a guide plate holder on the top and a guide plate to trigger a micro switch by sliding of the guide plate in order to start fan motors to suck oily smoke into a ventilation opening in the body. The oily smoke is then filtered by an oil filter element in a filter tank before it is discharged to the atmosphere. Oily contents at the fan motor and filter tank are collected by oil collectors and an oil pan, respectively.

DETAILED DESCRIPTION OF THE PREFERRED EMBODIMENT

Figure 1:
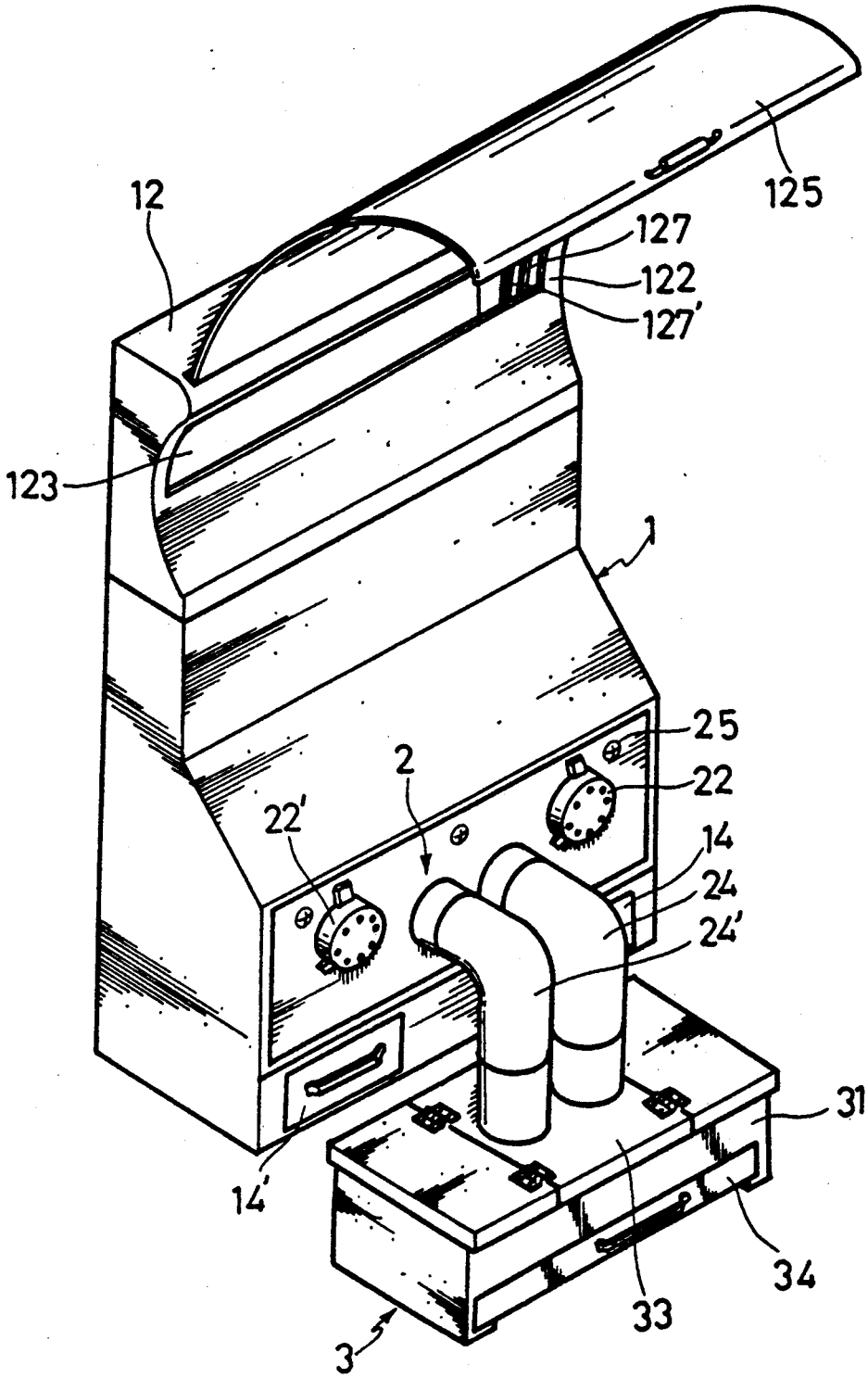
FIG. 1 is a perspective view of a preferred embodiment of a smokeless exhauster according to the present invention.
Figure 2:
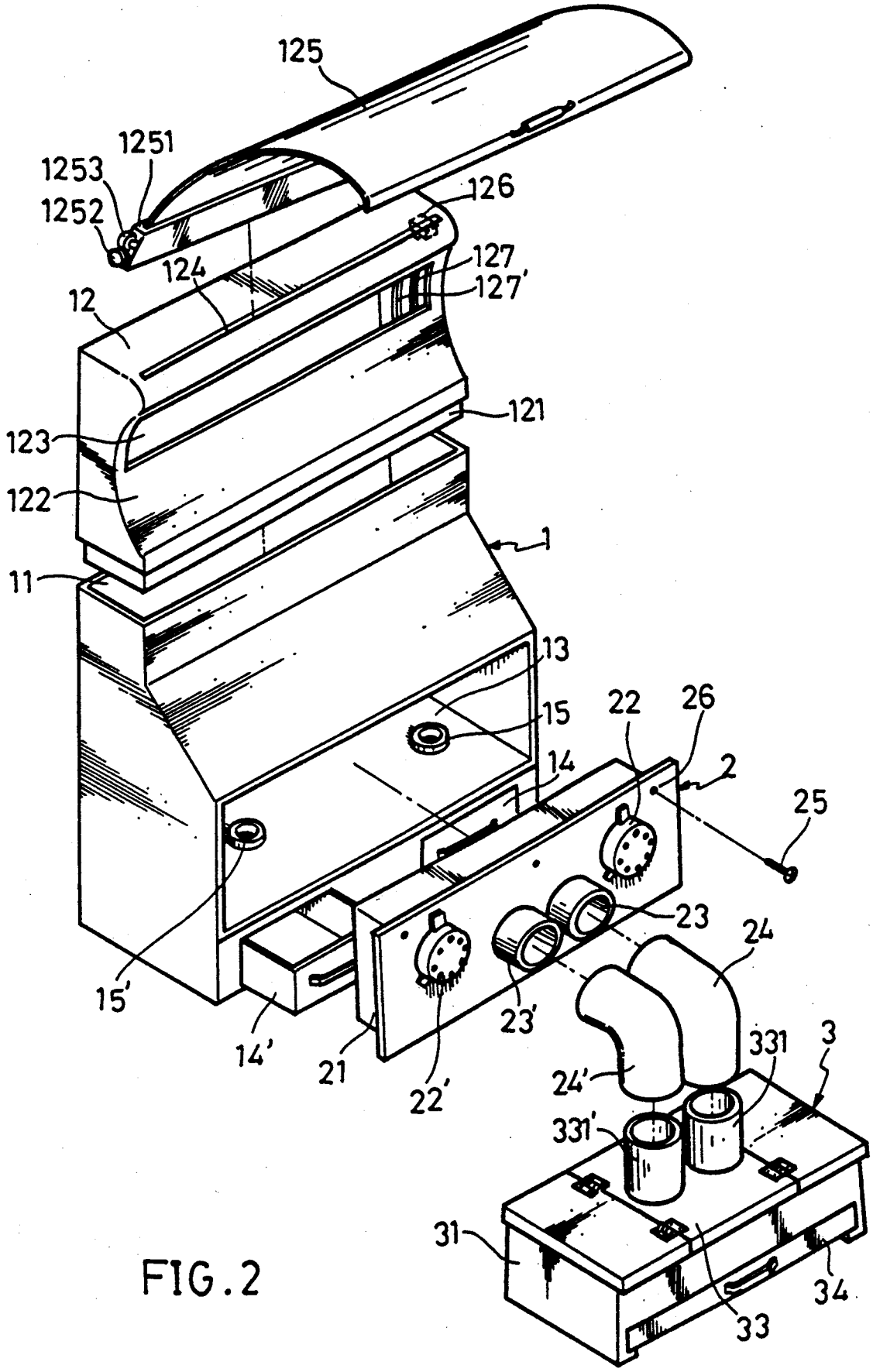
FIG. 2 is an exploded perspective view of the preferred embodiment according to the present invention.

As shown in FIGS. 1 and 2, the present invention is composed of main body 1, an air box body 2, and an oil filter chamber 3. On body 1 is provided an opening for receiving a guide plate holder 12 by means of a seating block 121. The guide plate holder 12 has a curvilinear wall surface 122 with a smoke exhaust port 123, and a positioning slot 124 on the top for positioning a curvilinear guide plate 125, which can be slid along the positioning slot 124. On the upper side of the guide plate 125 there is a micro switch 126 at an appropriate internal position in order to close a certain circuit when the micro switch 126 is triggered by movement of the guide plate 125. The circuit is used to start a fan motor of the air box body 2. Beneath the body 1 there is a ventilation opening 13 at an appropriate position, in which the air box body 2 is installed and secured by fixing holes 26 with fixing bolts 25. Beneath the body 2 there are two movable oil collectors 14 and 14' each with an oil discharge pipe 15 or 15' for collection of oil from two fan motors 22 and 22' installed on seating block 21 corresponding to the oil discharge pipes 15 and 15'. At the lower part of the body 2 there are two exhaust popes 23 and 23' passing through the air box body 2 for attachment to two connection pipes 224 and 24' which are also attached to the oil filter box 3.

Figure 3:
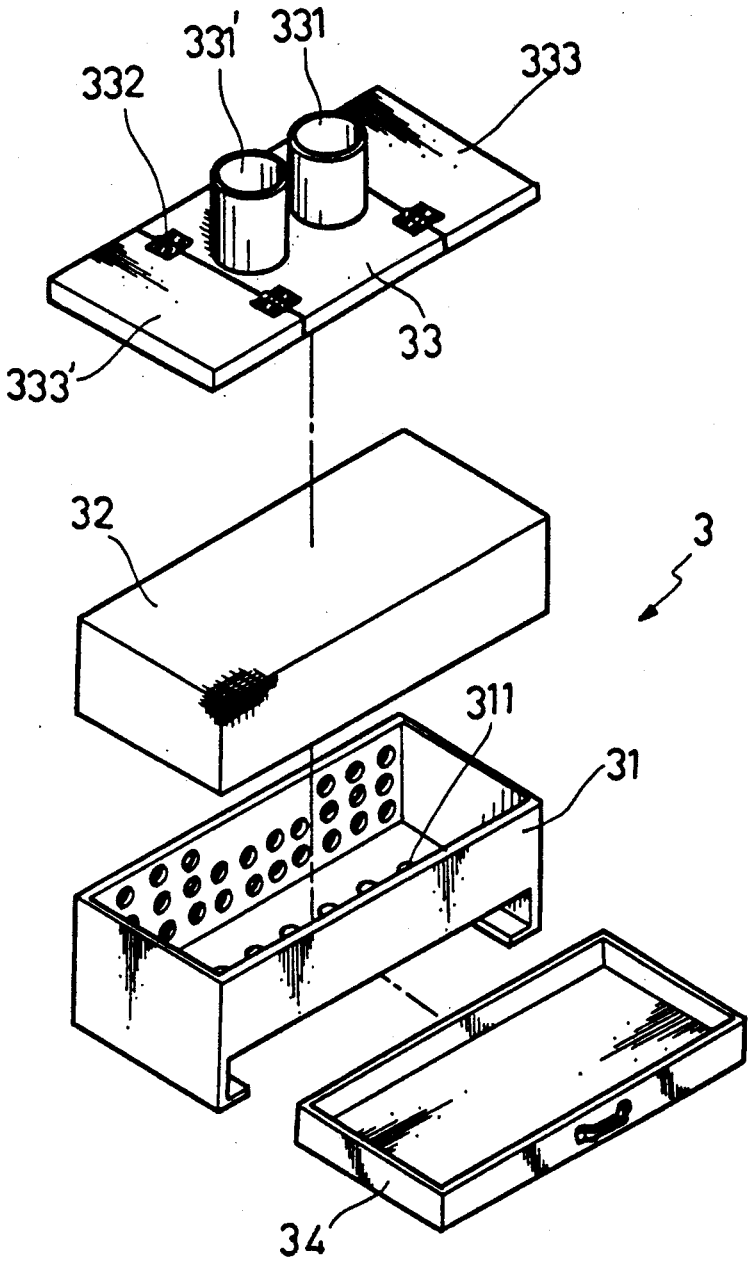
FIG. 3 is an exploded perspective view of an oil filter chamber according to the present invention.

As shown in FIG. 3, the oil filter chamber 3 comprises a filter tank 31 having a filter element 32 disposed in an opening 311. On top of the oil filter chamber 3 there is a detachable cover 33 with two intake pipes 331 and 331' at a middle portion connecting to two box covers 333 and 333' by means of hinges 332. The lower part of filter tank 31 is provided with an oil pan 34.

Figure 4:
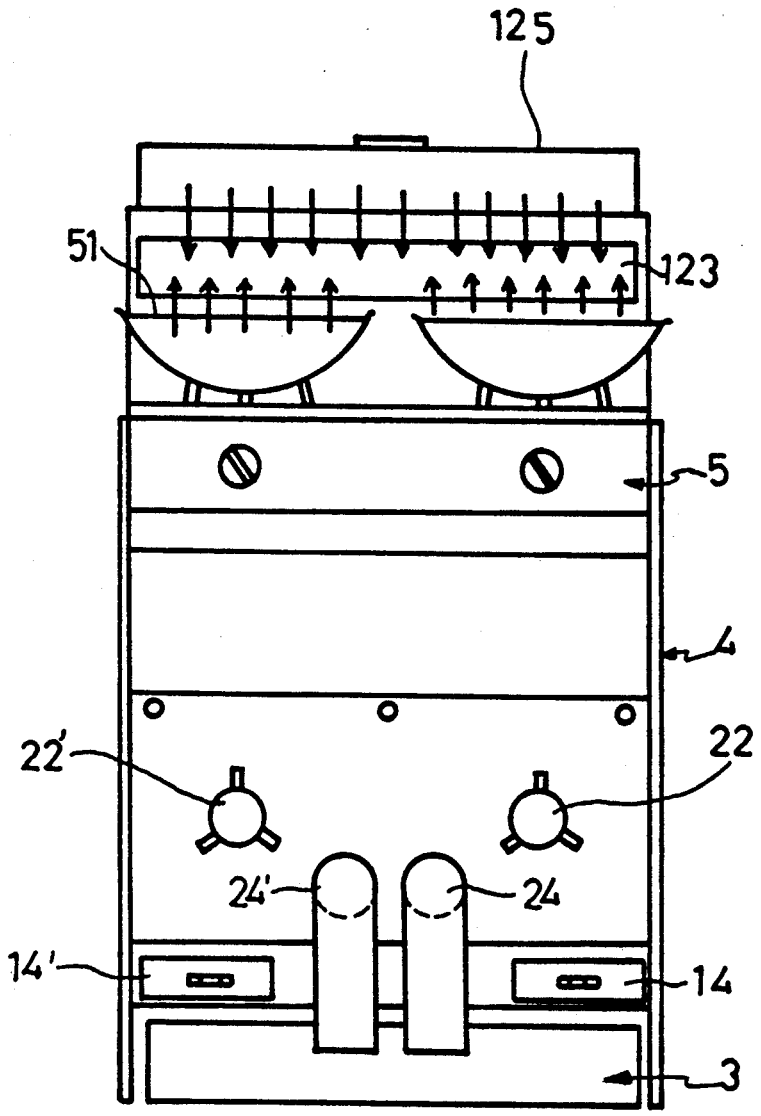
FIG. 4 is a schematic elevational view illustrating the operation of the preferred embodiment according to the present invention.
Figure 5:
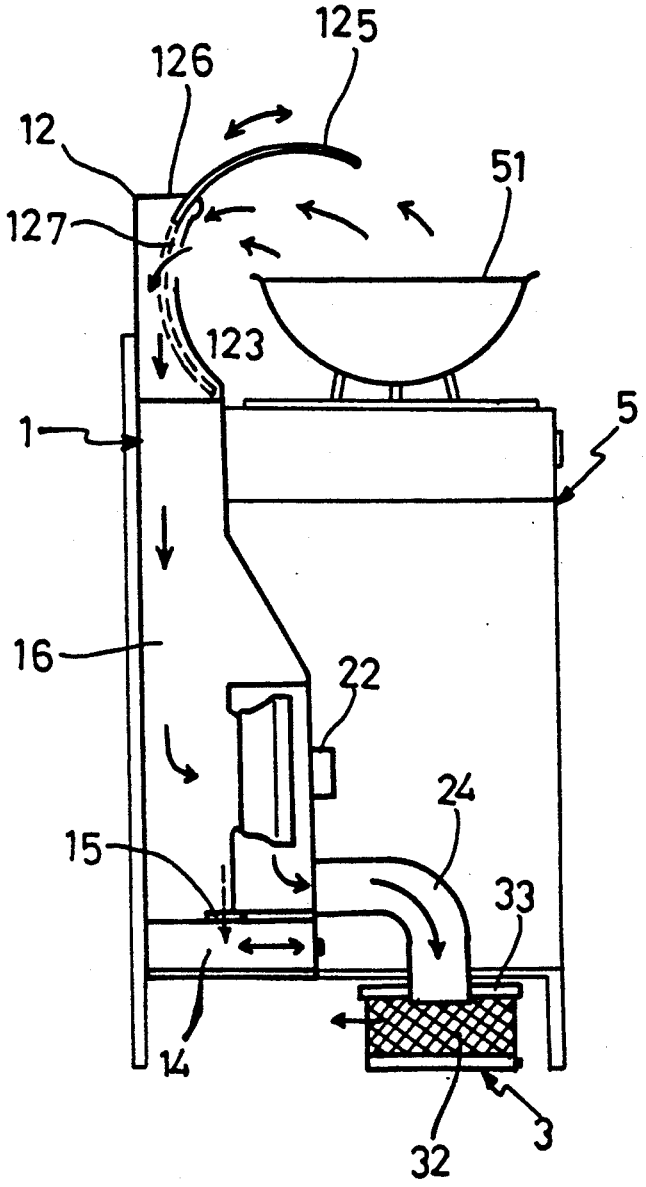
FIG. 5 is a side elevational view illustrating the preferred embodiment according to the present invention.
Figure 6:
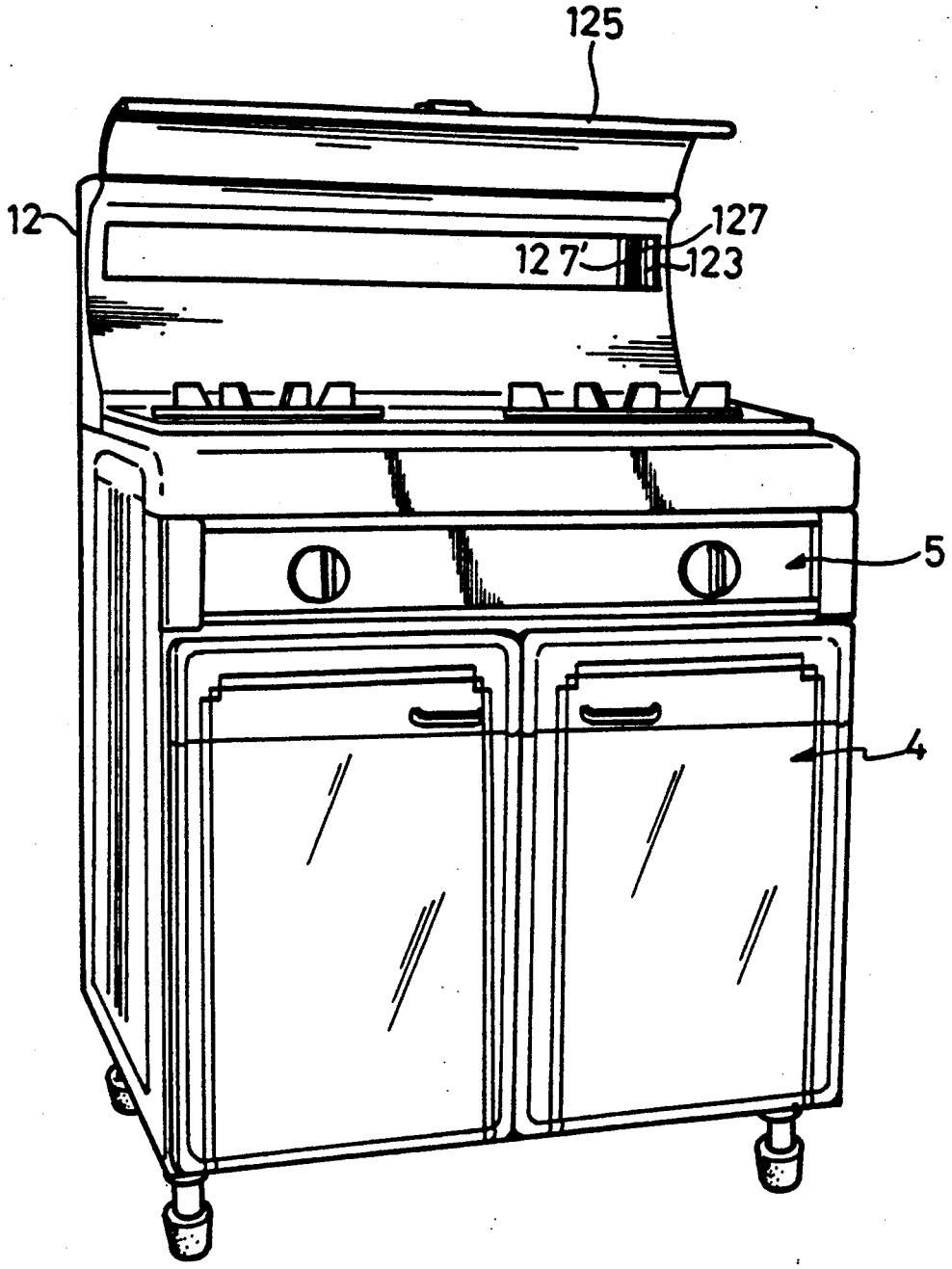
FIG. 6 is a perspective view of the preferred embodiment according to the present invention shown incorporated with an oven and a dispensing table.

As shown in FIGS. 4, 5 and 6, the present invention is an integrated part of a dispensing table 4 and an oven 5. When the curvilinear guide plate 125 is slid out, the micro switch 126 is triggered, which then starts the fan motors 22 and 22' to exhaust oily smoke from cooker 51 on the oven 5, in the direction as shown by arrows, to the smoke exhaust port 123, and then through the ventilation opening 13 and the connection pipes 24 and 24' to the oil filter chamber 3. Oily contents in the oily smoke are removed by the filter element 32 in the filter tank, and then collected in the oil pan 34. In this way, the smoke is filtered and becomes clean air before it is discharged from the exhauster. Oily contents remaining on the fan motors 22 and 23' are collected by the oil discharge pipes 15 and 15' of the oil collectors 14 and 14' beneath the body 1. The oil pan 34 and the oil collectors 14 and 14' are detachable design to ease removal of their oily contents.

The guide plate holder 12 is of detachable design to ease removal of oily contents therefrom.

Figure 7:
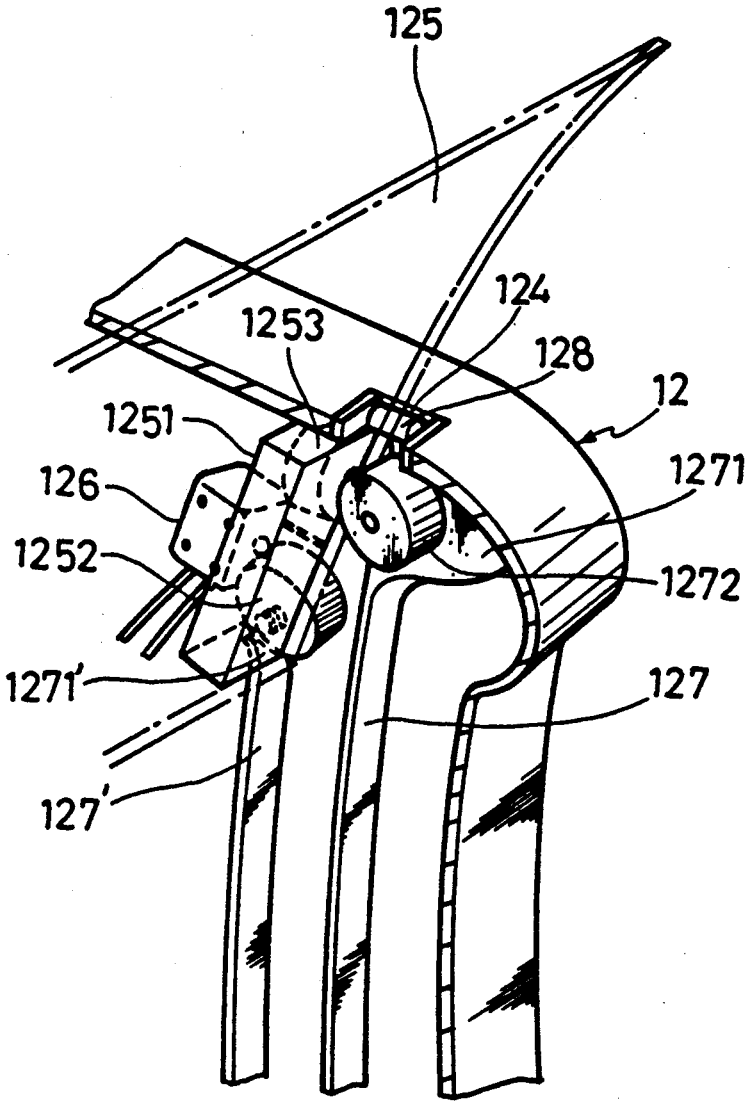
FIG. 7 is a partial perspective view of the structure of the guide plate according to the present invention.
Figure 8:
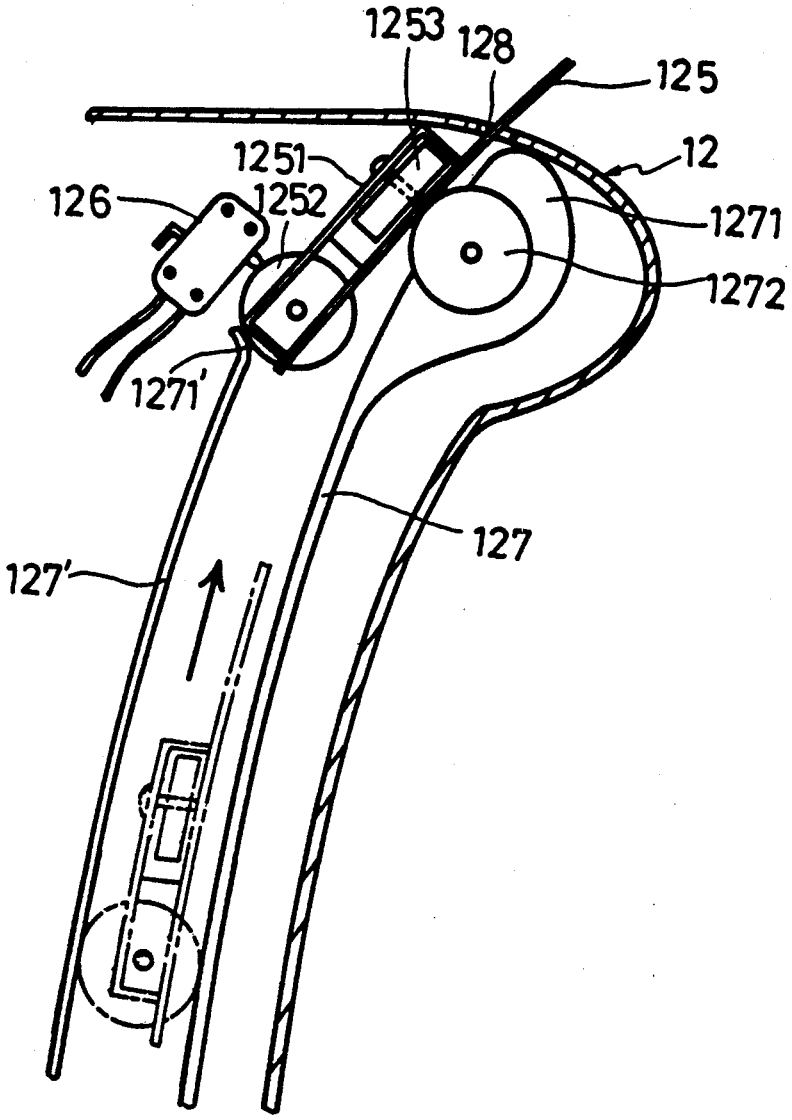
FIG. 8 is a partial side view illustrating the function of the guide plate according to the present invention.

As shown in FIGS. 7 and 8, the curvilinear guide plate 125 has a pair of fixing blocks 1251 at one end. The curvilinear guide plate 125 also has two symmetric rollers I and II (1252 and 1253) at each lateral side thereof, slidably installed on two parallel curvilinear rails 127 and 127' on the guide plate holder 12. A fixing element 1271 extends from the upper end of the rail 127 for installation of a roller III 1272 disposed below a positioning slot 124 provided with a positioning roller 128 therein to permit smooth sliding and contact of the guide plate 125. When the guide plate 125 is slid outwardly to the outermost position, a curvilinear position element 1271' at the upper end of rail 127' stops the roller I (1252) and causes it to contact a micro switch 126. In this way, whenever the guide plate 125 is slid to the outermost position, the micro switch 126 is triggered to connect the power source, and consequently the fan motors 22 and 22' are started. This is a configuration which permits automatic starting of the fan motors 22 and 22' to exhaust smoke without requiring a further actuation of a switch.

What is claimed is:

1. A vertical type smokeless exhauster comprising:

(a) a main body having a top portion and a bottom portion, a holder opening formed in the top portion, a ventilation opening formed in a lower sidewall of the main body, a pair of detachable oil collectors provided at the bottom portion, and a pair of oil discharge pipes positioned internally of the main body above the oil collectors;

(b) a guide plate holder detachably received within the holder opening of the main body and including a curvilinear wall surface, a smoke exhaust port, an upper side portion, and a positioning slot formed in the upper side portion;

(c) a curvilinear guide plate received through the positioning slot of the guide plate holder for sliding movement to an outermost portion;

(d) an air box body secured to the main body, the air box body including a seating block disposed in the ventilation opening, a pair of fan motors positioned adjacent the pair of oil discharge pipes, and a pair of exhaust pipes extending through the air box body;

(e) an oil filter chamber including a filter tank, a filter element disposed within the filter tank, a detachable cover, a pair of intake pipes supported on the cover and a detachable oil pan positioned below the filter tank; and (f) pipe means connecting the pair of exhaust pipes of the air box body to the pair of intake pipes of the oil filter chamber.

2. The vertical type smokeless exhauster of claim 1 wherein the guide plate holder includes a microswitch for actuating the pair of fan motors, the microswitch being triggered by the guide plate when the latter is disposed in its outermost position.

3. The vertical type smokeless exhauster of claim 1 further including a dispensing table and an oven.

4. The vertical type smokeless exhauster of claim 1 wherein the guide plate includes a fixing block at one end thereof, a pair of rollers mounted on the fixing block and offset from each other by ninety degrees, the guide plate holder including a pair of parallel curvilinear rails, a positioning element extending from an upper end of one rail and a roller mounted on the positioning element, a positioning roller supported in the positioning slot of the guide plate holder and engageable by the guide plate when the guide plate is slid between the two curvilinear rails.

5. The vertical type smokeless exhauster of claim 1 wherein the guide plate holder includes an inner wall and a pair of parallel rails extending along the inner wall, one rail being an innermost rail adjacent the inner wall, the innermost rail including an upper end provided with a curvilinear positioning element, a microswitch mounted adjacent an upper end of the other rail, the microswitch being connected to a power source and the pair of fan motors to form a circuit therewith, a roller carried by the guide plate, whereby when the guide plate is slid to its outermost position, the roller triggers the microswitch and initiates operation of the fan motors.

* * * * *